US006385137B1

(12) United States Patent
Porter et al.

(10) Patent No.: US 6,385,137 B1
(45) Date of Patent: May 7, 2002

(54) SEPARATION TIMER HAVING A VISUALLY PROMINENT TIMING-KEY

(76) Inventors: Robert Austin Porter; Richard Steven Porter, both of 1056 Auburn St., Livermore, CA (US) 94550

( * ) Notice: Subject to any disclaimer, the term of this patent is extended or adjusted under 35 U.S.C. 154(b) by 0 days.

(21) Appl. No.: 09/541,272

(22) Filed: Apr. 1, 2000

(51) Int. Cl.[7] ..... G04F 10/00; G04F 8/00
(52) U.S. Cl. ..... 368/110; 368/113
(58) Field of Search ..... 368/9, 10, 69, 368/107–113; 340/309.15, 309.4

(56) References Cited

U.S. PATENT DOCUMENTS 4,956,825 A * 9/1990 Wilts et al. ..... 368/9
5,119,346 A * 6/1992 Henderson et al. ..... 368/109
5,335,212 A * 8/1994 Bartos ..... 368/107

* cited by examiner

*Primary Examiner*—Vit Miska
(74) *Attorney, Agent, or Firm*—James M. Ritchey

(57) ABSTRACT

A timing device for tracking the length of time a user is absent from a particular location comprises a base member that includes a housing, a timer mounted to the housing, a display connected to the timer, and a timing-key receiver attached to the housing and in communication with the timer and utilized in starting and stopping the timer. Provided is a visually prominent timing-key releasably mountable to the timing-key receiver that comprises a key body and a coupler attached to the key body which releasably mates with the timing-key receiver. The device is commonly employed in tracking how long a student is temporarily absent from a classroom.

24 Claims, 6 Drawing Sheets

SEPARATION TIMER HAVING A VISUALLY PROMINENT TIMING-KEY

BACKGROUND OF THE INVENTION

1. Field of the Invention

A timer is disclosed for monitoring or tracking the amount of time between the removal of a visually prominent timing-key from a base member and the return of the visually prominent timing-key to the base member. More particularly, a separation or interval timer utilized by a person needing to establish a desired time interval, such as a teacher, is presented that comprises a removable visually prominent timing-key mounted in a receiving base member. For a teacher's common situation, when a student needs to leave a classroom for a known and/or limited period of time the student removes the visually prominent timing-key which activates the timing means, usually within the base member. Upon returning to the classroom the student replaces the visually prominent timing-key into the receiving member and the timing means is deactivated. The interval between leaving and returning is monitored by appropriate means associated with the subject device.

2. Description of the Background Art

For most likely as long as there have been students under a teacher's care teachers have found it helpful, necessary, useful, required, or even mandated to monitor the length of time a student has left the classroom on whatever task, chore, or personal errand may be the justification for leaving the classroom. When a teacher has many students in a classroom it is often very difficult, inconvenient, or virtually impossible to monitor the period of time one or more students may be out of the classroom. Standard tracking attempts have consisted of placing the student on his/her honor as to time requirement, but often a student does not have a watch to track the time, and the teacher or student writing the exit time on a chalkboard or paper, but this requires notations such as the student's name, the exit time, and the like for each student who leaves the classroom and such notations may not be practical for a busy teacher. Of course, there are students who intentionally extend the out-of-classroom time period as long as possible, and then some.

The foregoing information reflects the state of the art of which the applicant is aware and is discussed with the view toward discharging applicant's acknowledged duty of candor in disclosing information which may be pertinent in the examination of this application. It is respectfully submitted, however, that the tendered information does not teach or render obvious applicant's claimed invention.

SUMMARY OF THE INVENTION

An object of the present invention is to provide a timing device that permits a teacher or other user to establish how a student or like person has been out of a room.

Another object of the present invention is to furnish a timing device that functions automatically to track how long a person has been away from an identified location.

A further object of the present invention is to supply a timing device that displays how long a timing-key has been separated from a base member.

Still another object of the present invention is to disclose a timing device that includes a recall ability to present current and previously tracked time intervals.

Yet a further object of the present invention is to describe a method of monitoring the time a person has been away from a base location and in particular the temporary absence of a student from a classroom.

Disclosed is a timing device that comprises a base member, which in turn comprises; a housing, a timer mounted to the housing, a display connected to the timer, and a timing-key receiver attached to the housing and in communication with the timer and utilized in starting and stopping the timer. Additionally comprising the subject timer device is a visually prominent timing-key releasably mountable to the timing-key receiver and utilized in starting and stopping the timer. The timing key is easily seen and comprises a key body and a coupler attached to the key body which releasably mates with the timing-key receiver. The timer is preferably an electronic timer, but may be any suitable equivalent such as a mechanical timer. Usually, the display is an electronic visual display panel that utilizes standard visualization procedures such as LCD technology and the like.

The visually prominent timing-key may further comprise an indicator for presenting time information regarding a length of separation time. The time information indicator may be an electronic display, an auditory announcer, or a set of lights, wherein the lighting of a light within the set of lights indicates a given time period.

For the sake of record keeping, a printer for printing time information regarding a length of the separation time for the visually prominent timing-key from the timing-key receiver may be included. Also, input means may be included in the base member for entering identification codes for the users of the timing device.

To assist in the process of tracking the time a person is temporarily absent from a specific location, optionally included is a remote sensing system for verifying that the visually prominent timing-key reaches an intended destination. The remote sensing system comprises; a receiver in the base member for accepting information from a remote destination, a remote base member, a remote timing-key receiver mounted in the remote base member, and a transmission module mounted in the remote base member and in communication with the remote timing-key receiver for noting and relaying information to the receiver in the base member regarding mating of the visually prominent timing-key with the remote timing-key receiver.

The timing device just described is utilized in a method for tracking a time interval a user, frequently a student, has been away from a base location, usually a classroom, to an intended destination, library, restroom, and the like. The method comprises the steps of: providing a timing device, as described above, removing by the user the visually prominent timing-key from the timing-key receiver, thereby starting the timer and commencing the time interval the user will be away from the base location, taking by the user the visually prominent timing-key away from the base location, and stopping the timer by mating the visually prominent timing-key with the timing-key receiver. Additionally, the method for tracking a time interval may further comprise the step of the user activating a remote sensing system, as described above, by mating said visually prominent timing-key with said remote timing-key receiver.

Other objects, advantages, and novel features of the present invention will become apparent from the detailed description that follows, when considered in conjunction with the associated drawings.

DESCRIPTION OF THE PREFERRED EMBODIMENT

Figure 1:
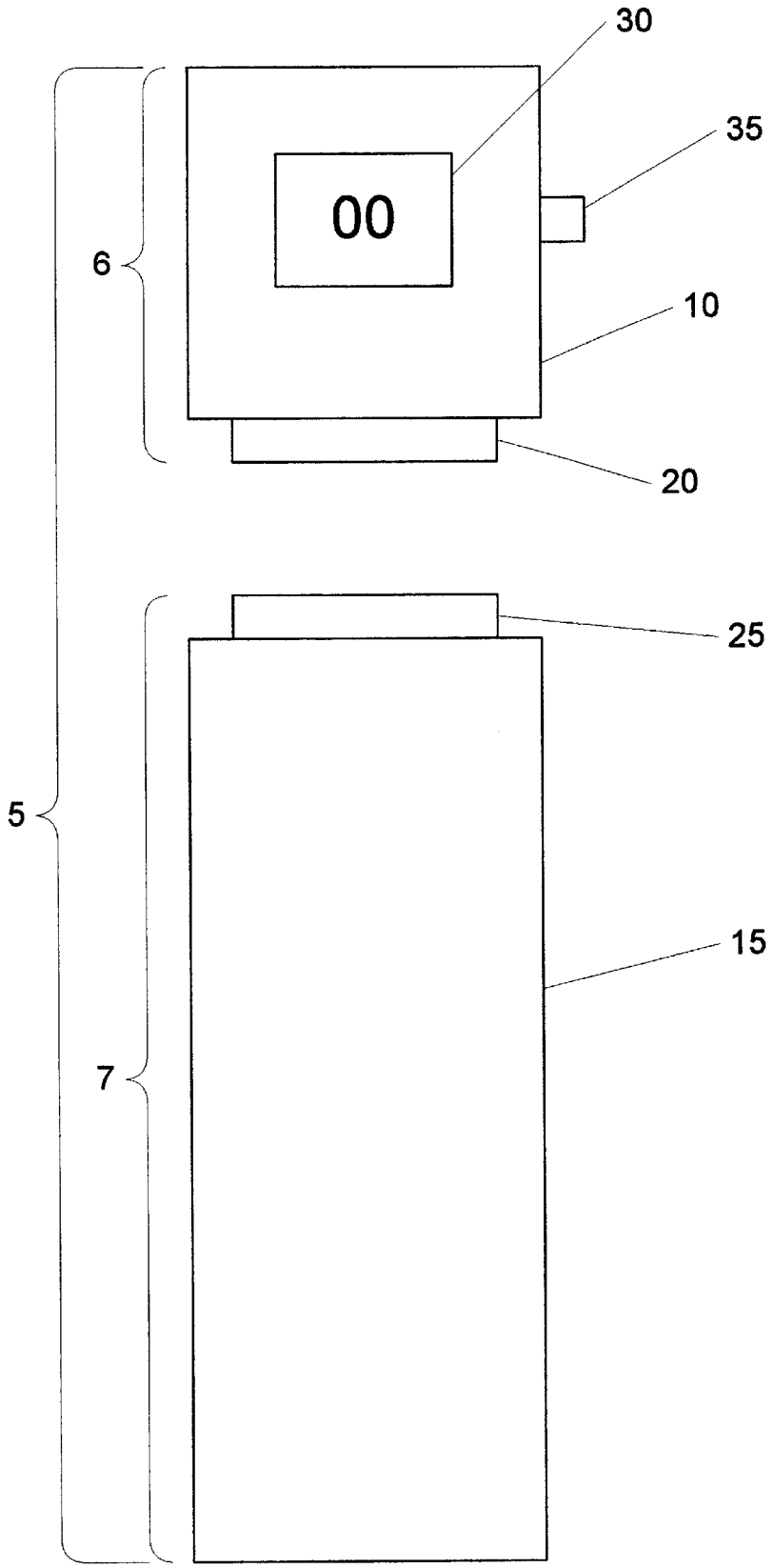
FIG. 1 presents one embodiment of the subject invention.
Figure 3:
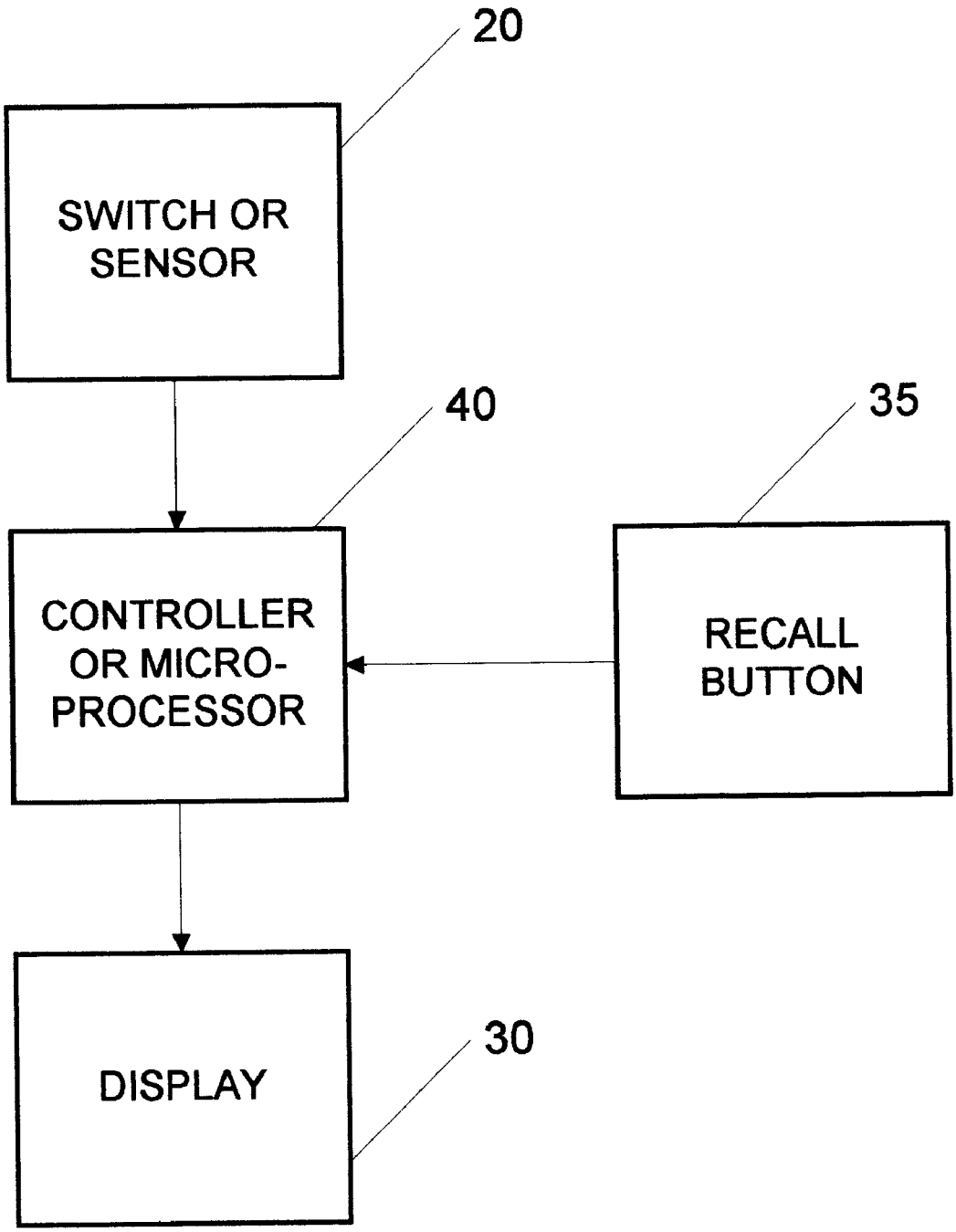
FIG. 3 is a flow diagram for relating the processor to other elements of the subject invention.
Figure 4:
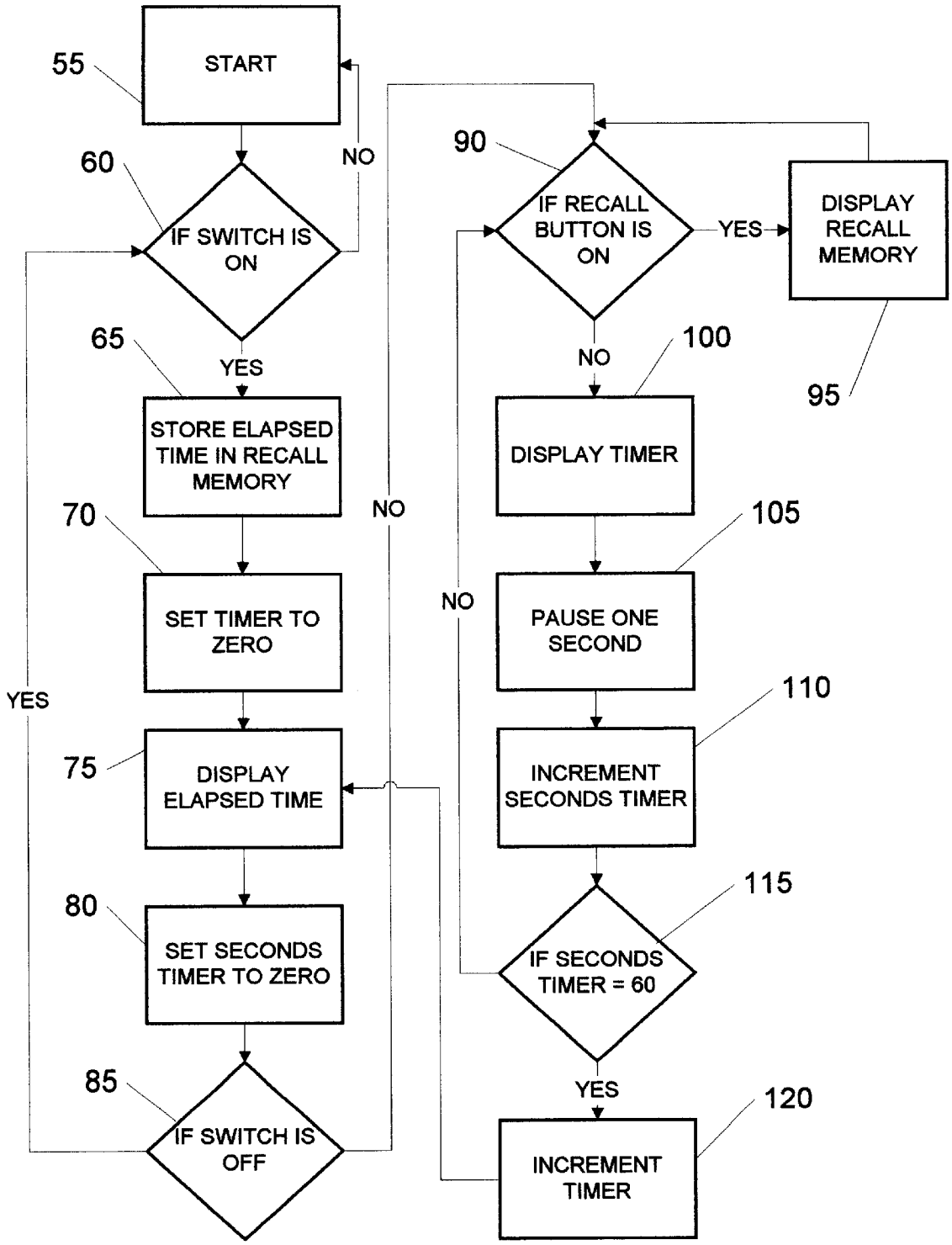
FIG. 4 is a flow diagram showing exemplary steps in the operation of the subject invention.
Figure 5:
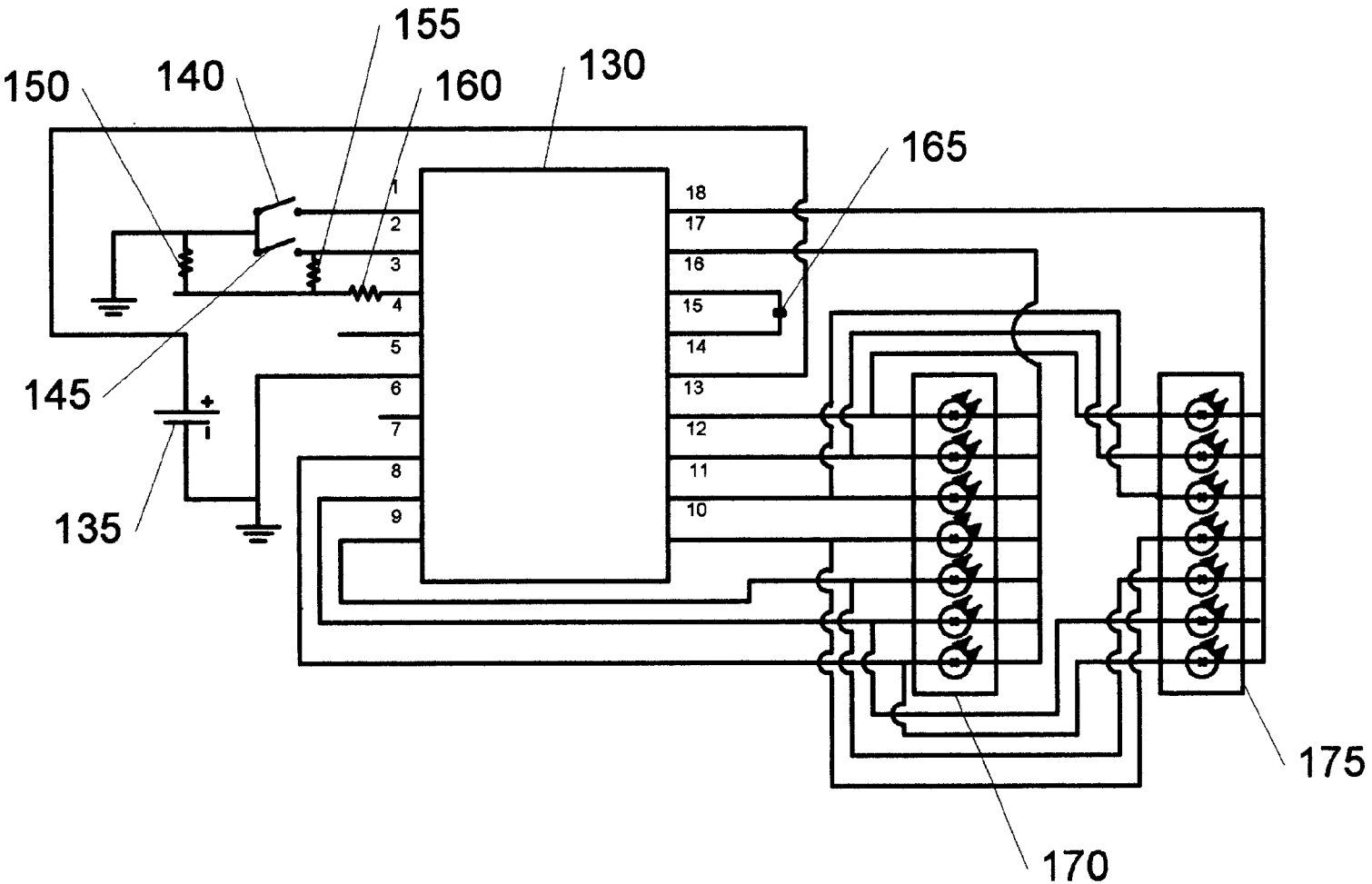
FIG. 5 shows a representative electronic controller for the subject invention.

Referring now to FIGS. 1–6, there are shown preferred embodiments of the subject invention. More specifically, as shown in FIG. 1, the subject timing device 5 comprises a base member 6 (termed a home base member when used in conjunction with a remote base member, see below), having a containing housing or case 10, a timer mounted to or within the housing (an exemplary controller having a timer is shown in FIG. 5), a display 30 connected to the timer and usually visible to a user, and a timing-key receiver 20 and in communication with the timer (usually by hard wiring or an equivalent means) and utilized in starting and stopping the timer, and a visually prominent timing-key 7 releasably mountable to the timing-key receiver 20, via its coupler 25 and utilized in starting and stopping the timer.

The home base member 6 is fabricated from suitable material such as wood, wood product, polymeric substance, or other suitable composition. The timing-key receiver 20 comprises a "switch" that is activated and deactivated by contact with the coupler 25 found on the timing key 7. The receiver 20/coupler 25 interaction may be by physical, magnetic, induction, or other equivalent means for the activation and deactivation process, but usually includes a means for physically attaching the key 7 to the base 6, such as by magnetic or physical coupling. One part of the receiver 20/coupler 25 pair may be a female socket and the other a male plug that interact via direct or indirect means to turn on and turn off the timer and associated display 30. The display is generally a liquid crystal type, but other displays are considered to be within the realm of this disclosure. The display 30 is controlled by the microprocessor and displays elapsed time and other relevant data such as an identifying code for each user and the like.

Specifically, the timing-key 7 comprises a key body 15 and the coupler 25 attached to the key body 15 which releasably mates with the timing-key receiver 20. When the key 7 is separated from the home base 6 the timing processes is initiated and the elapsed time displayed on the display 30, usually the electronic visual display noted above. The timer, for tracking the elapsed time the key 7 is separated from the home base 6, is usually an electronic timer controlled by an appropriate microprosessor but may be a mechanical timer or equivalent, if desired.

Additionally, a recall button or switch 35 is generally included in the subject devise to display the elapsed time (to recall from the memory of the associated controller the elapsed time). Clearly, the function of the recall button 35 can be included in the actual coupling between the key 7 and the base 6 so that when the receiver 20 and the coupler 25 mate the display is actuated automatically.

Figure 2:
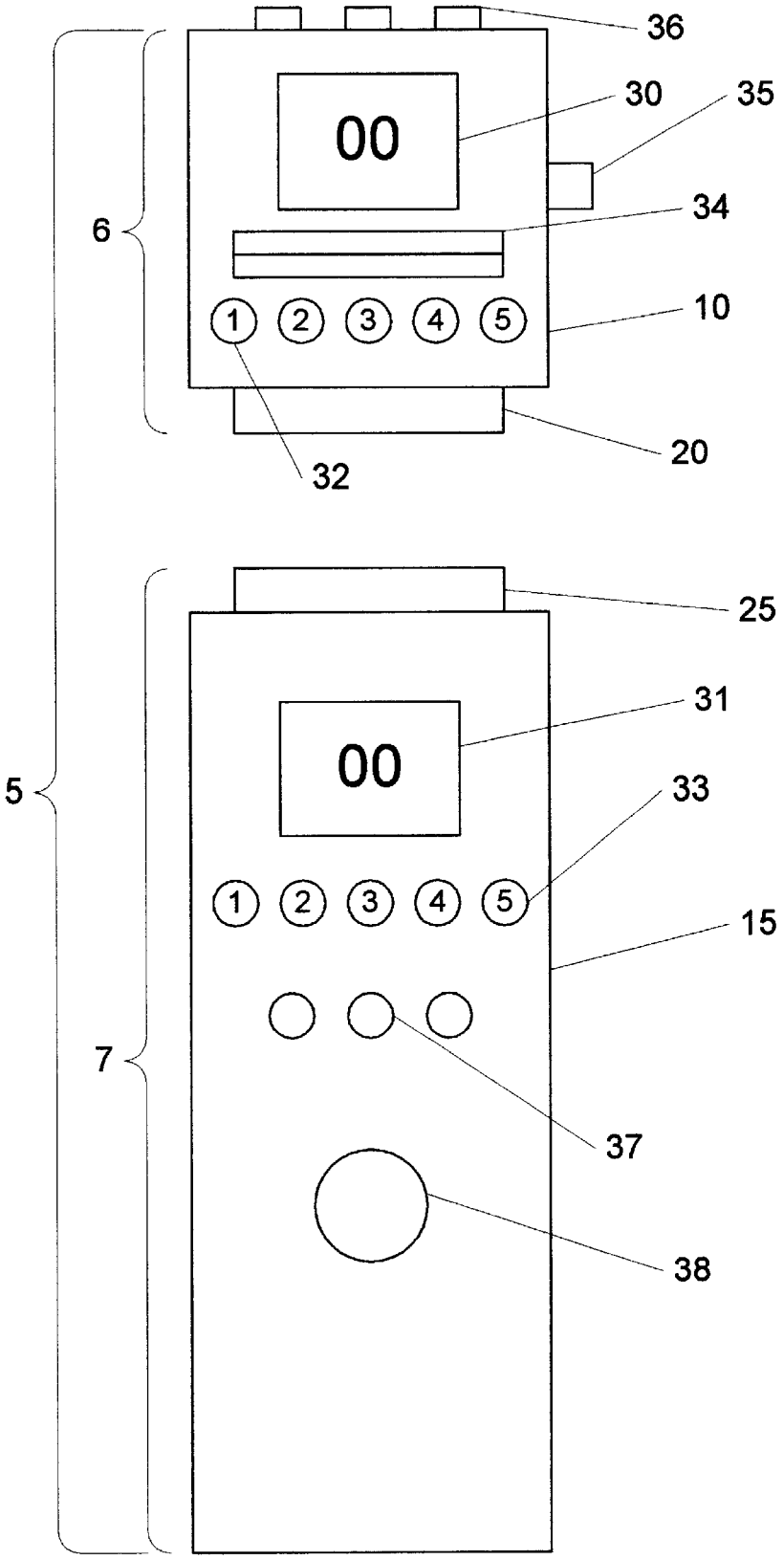
FIG. 2 illustrates another embodiment of the subject invention that includes optional features.

FIG. 2 depicts an embodiment of the subject invention in which optional features are included. To assist in utilizing the subject device in an efficient manner, both the home base 6 and the visually prominent timing-key 7 may further comprise indicators for presenting time information regarding a length of separation time of the key 7 from the home base 6. In addition to the timing display 30 on the home base 6 an additional time information indicator may be included. The additional time information indicator includes, but is not limited to a secondary electronic display 31 located on the timing-key 7. The person having the key 7 can note the exact time of separation and be aware of time limits that may be involved. Also, a set of lights that indicate time periods may be included on both or either the base 6 (see lights 36) and key 7 (see lights 37). For example, the lighting of a light within either set of lights (36 or 37) indicates a given time period, perhaps green, yellow, and red lights. Further, an auditory announcer or speaker 38 may be included in the key 7 to sound when preselected time intervals have elapsed. Clearly, the driving power and controlling electronics would be of a standard format and be included within the base 6 and key 7 members.

It may be useful for the person having the key 7 to be specifically identified, therefore, the base member may further include an input means for entering an identification code for each user of the timing device. The input means may be a series of buttons 32 and 33 on the base 6 and timing-key 7. Entering a given identification code (series of pushed buttons) indicates to the controlling microprocessor that a particular person is using the subject device. Such usage can be tracked by means of a suitably programmed controlling microprocessor.

For the generation of a detailed tracking record of separation times and identification codes, the home base 6 may be fitted with a suitable printer for printing time and identification information.

FIG. 3 depicts a basic or generalized controll scheme in which exemplary components of the subject device are related. The switch or sensor 20 (mating and separating the base receiver 20 and the key coupler 25 would deactivate/activate the timing process) regulates the timing process and communicates with the controller or microprocessor 40 the proper timing state (e.g., start tracking the separation time when the key 7 is removed from the home base 6 or stop tracking the separation time when the key 7 is returned and mated to the home base 6). The recall button 35 interacts with the controller or microprocessor 40 to display the elapsed time which is presented on the display 30.

FIG. 4 relates an exemplary control flow diagram for the subject invention and it is noted that equivalent schemes are within the scope of this disclosure. To start the timing process 55 the state of the switch 60 (the mated or separated receiver 20/coupler 25) is determined. If the switch is not on the process loops to the start position 55, but if the switch is on the elapsed time in the recall memory is stored 65. The timer is then set to zero 70. Next the display shows the elapsed time 75 and then the seconds timer is set to zero 80. Following the timer zeroing 80 is a determination if the switch in now off 85. If the switch is off then the process returns, as indicated, to step 60. However, if the switch is on the process proceeds to determine if the recall button is on 90 and if it is the recall memory time is displayed 95. If the recall button is not on the timer is displayed 100. The timer notes a one second pause or passage 105 (this could clearly be other time intervals, if desired) and then the seconds timer is incremented 110. If the seconds timer does not equal 60 seconds 115 then the process loops back to step 90. If the seconds timer equals 60 seconds 115 then the timer is incremented by one unit 120 (one minute in this example, but other shorter or longer periods of time could be included) and the elapsed time is displayed 75.

FIG. 5 depicts an exemplary electronic circuit for controlling one embodiment of the subject invention. Clearly, this or other equivalent controllers that direct the additional features (sound producing elements, lighting displays, remote reporting features, and the like) presented herein are contemplated to be within the realm of this disclosure and invention and would be within the skill of a suitably qualified artisan knowing the content of this disclosure. In particular, FIG. 5 illustrates a controlling circuit that centers on a microprocessor chip 130 (for example a PIC-16c54 microcontroller from MICROCHIP). Power for the microchip 130 is usually provided by a suitable battery 135 or equivalent power source. The microchip 130 is a programmable microprocessor that is responsible for all of the desired timing and reporting functionalities. The microchip 130 runs a program which checks the status of both switches 140 (for example a SPST switch such as a TP11SH9CBE from C & K, Inc. which controls the voltage to a input pin on the microchip 130) and 145 (for example a Reed switch such as a MDCG-4-12-33 from the Hamlin Corp. that controls the voltage to another input pin on the microchip 130) and appropriately updates the display 170 and 175 (for example an LED such as a P333-ND from Panasonic Corp. that displays up to two digits of elapsed time).

Electrically connected to appropriate leads of the microchip 130 is a crystal 165 (for example a 4 mhz crystal-x006-ND from ECS, Inc.) that forms part of the oscillator circuit in conjunction with the microchip 130. As needed suitable resistors 150, 155, and 160 (for example 10K resistors at ⅛ watt from Yageo Corp.) are included to limit the current to suitable levels needed by the microchip 130.

Figure 6:
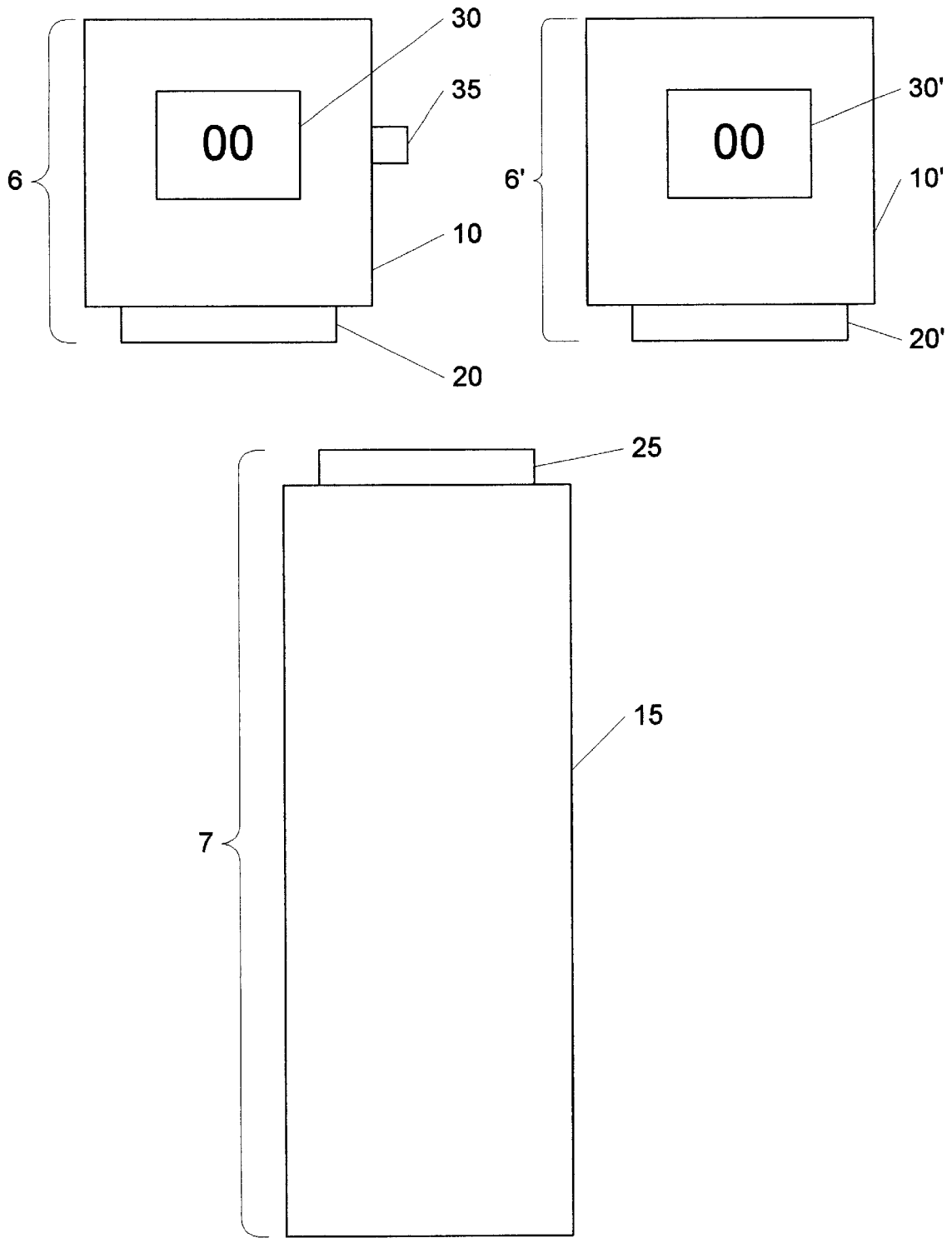
FIG. 6 depicts an embodiment of the subject invention that comprises a home base and a remote base.

FIG. 6 illustrates an embodiment of the subject invention that comprises both a home base 6 and a remote base 6' in which a user docks the timing-key 7 with a remote base 6' at the timing-key receiver 20'. A display 30' that presents the elapsed time may or may not be present in the remote base 6'. Clearly, the home base 6 and the remote base 6' would be in communication with one another by standard techniques including hard wiring and various non-wired methods such as limited radio signals and the like. Suitable controller mechanisms would be included in the bases 6 and 6' that are within the fabrication skill held by those skilled in the relevant arts. This embodiment would permit a remote unit 6' to be positioned at various destination locations and indicate to the home base 6 whether the user had reached any desired location by sending a signal to the home base 6 when the timing-key 7 was docked with the remote base 6'. Thus, an appropriate receiver would be in the home base member 6 for accepting information from a remote base member 6' located at a remote destination. A transmission module would be mounted in the remote base member 6' and in communication with the remote timing-key receiver 20' for noting and relaying information to the receiver in the home base member 6 regarding mating of the visually prominent timing-key 7 with the remote timing-key receiver 20'.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A timing device comprising:

a) a base member comprising:
- i) a housing;
- ii) timer means mounted within said housing;
- iii) display means connected to said timer; and
- iv) a timing-key receiver attached to said housing and in communication with said timer and b) a visually prominent timing-key releasably mountable to said timing-key receiver, wherein timing is started when said timing-key is separated from said timing-key receiver and timing is stopped when said timing-key is returned to said timing-key receiver.

2. A timing device according to claim 1, wherein said timing means is selected from a group consisting of an electronic timer and a mechanical timer.

3. A timing device according to claim 1, wherein said display means comprises a visual display panel.

4. A timing device according to claim 1, wherein said visually prominent timing-key further comprises indicator means for indicating time information regarding a length of separation time for said visually prominent timing-key from said timing-key receiver.

5. A timing device according to claim 1, wherein said base member further comprises a printer for printing time information regarding a length of separation time for said visually prominent timing-key from said timing-key receiver.

6. A timing device according to claim 1, wherein said base member further includes input means for entering an identification code for each user of said timing device.

7. A timing device according to claim 1, wherein said timing device further comprises a remote sensing system for verifying said visually prominent timing-key reaches an intended destination, wherein said remote sensing system comprises:

a) a receiver in said base member for accepting information from a remote destination;

b) a remote base member;

c) a remote timing-key receiver mounted in said remote base member;

d) a transmission module mounted in said remote base member and in communication with said remote timing-key receiver for noting and relaying information to said receiver in said base member regarding mating of said visually prominent timing-key with said remote timing-key receiver.

8. A timing device comprising:

a) a base member comprising:
- i) a housing;
- ii) a timer mounted to said housing;
- iii) a display connected to said timer; and
- iv) a timing-key receiver attached to said housing and in communication with said timer and utilized in starting and stopping said timer and b) a visually prominent timing-key releasably mountable to said timing-key receiver and utilized In starting and stopping said timer, wherein timing is started when said timing-key is separated from said timing-key receiver and timing Is stopped when said timing-key is returned to said timing-key receiver, comprising:
- i) a key body and
- ii) a coupler attached to said key body which releasably mates with said timingkey receiver.

9. A timing device according to claim 8, wherein said timer is selected from a group consisting of an electronic timer and a mechanical timer.

10. A timing device according to claim 8, wherein said display comprises an electronic visual display panel.

11. A timing device according to claim 8, wherein said visually prominent timing-key further comprises an indicator for presenting time information regarding a length of separation time for said visually prominent timing-key from said timing-key receiver.

12. A timing device according to claim 11, wherein said time information indicator is selected from a group consisting of an electronic display, an auditory announcer, and a set of lights, wherein the lighting of a light within said set of lights indicates a given time period.

13. A timing device according to claim 8, wherein said base member further comprises a printer for printing time information regarding a length of separation time for said visually prominent timing-key from said timing-key receiver.

14. A timing device according to claim 8, wherein said base member further includes input means for entering an identification code for each user of said timing device.

15. A timing device according to claim 8, wherein said timing device further comprises a remote sensing system for verifying said visually prominent timing-key reaches an intended destination, wherein said remote sensing system comprises:

a) a receiver in said base member for accepting information from a remote destination;

b) a remote base member;

c) a remote timing-key receiver mounted in said remote base member;

d) a transmission module mounted in said remote base member and in communication with said remote timing-key receiver for noting and relaying information to said receiver in said base member regarding mating of said visually prominent timing-key with said remote timing-key receiver.

16. A method for tracking a time interval a user has been away from a base location to an intended destination, comprising the steps:

a) providing a timing device comprising:

i) a base member comprising:

a housing;

a timer mounted to said housing;

a display connected to said timer; and a timing-key receiver attached to said housing and in communication with said timer and utilized for starting and stopping said timer and ii) a visually prominent timing-key releasably mountable to said timing-key receiver and utilized in starting and stopping said timer, comprising: a key body and a coupler attached to said key body which releasably mates with said timing-key receiver;

b) removing by the user said visually prominent timing-key from said timing-key receiver, thereby starting said timer and commencing the time interval the user will be away from the base location;

c) taking by the user said visually prominent timing-key away from said base location; and d) stopping said timer by mating said visually prominent timing-key with said timing-key receiver.

17. A method for tracking a time interval according to claim 16, wherein said timer is selected from a group consisting of an electronic timer and a mechanical timer.

18. A method for tracking a time interval according to claim 16, wherein said display comprises an electronic visual display panel.

19. A method for tracking a time interval according to claim 16, wherein said visually prominent timing-key further comprises an indicator for presenting time information regarding a length of separation time for said visually prominent timing-key from said timing-key receiver.

20. A method for tracking a time interval according to claim 19, wherein said time information indicator is selected from a group consisting of an electronic display, an auditory announcer, and a set of lights, wherein the lighting of a light within said set of lights indicates a given time period.

21. A method for tracking a time interval according to claim 16, wherein, wherein said base member further comprises a printer for printing time information regarding a length of separation time for said visually prominent timing-key from said timing-key receiver.

22. A method for tracking a time interval according to claim 16, wherein said base member further includes input means for entering an identification code for each user of said timing device.

23. A method for tracking a time interval according to claim 16, wherein said timing device further comprises a remote sensing system for verifying said visually prominent timing-key reaches an intended destination, wherein said remote sensing system comprises:

a) a receiver in said base member for accepting information from a remote destination;

b) a remote base member;

c) a remote timing-key receiver mounted in said remote base member;

d) a transmission module mounted in said remote base member and in communication with said remote timing-key receiver for noting and relaying information to said receiver in said base member regarding mating of said visually prominent timing-key with said remote timing-key receiver.

24. A method for tracking a time interval according to claim 23, further comprising the step of the user activating said remote sensing system by mating said visually prominent timing-key with said remote timing-key receiver.

* * * * *